US007363869B1

(12) United States Patent
Yang

(10) Patent No.: US 7,363,869 B1
(45) Date of Patent: Apr. 29, 2008

(54) ALL-PURPOSE SEWING MACHINE

(75) Inventor: Kun-Nan Yang, Taichung (TW)

(73) Assignee: Semlima Industrial Co., Ltd., Taichung (TW)

( * ) Notice: Subject to any disclaimer, the term of this patent is extended or adjusted under 35 U.S.C. 154(b) by 0 days.

(21) Appl. No.: 11/701,543

(22) Filed: Feb. 2, 2007

(51) Int. Cl.
*D05B 15/00* (2006.01)
*D05B 73/00* (2006.01)

(52) U.S. Cl. ..... 112/62

(58) Field of Classification Search ..... 112/28, 112/39, 47, 2.1, 50, 51, 62, 470.13, 475.08; 74/471 R
See application file for complete search history.

(56) References Cited

U.S. PATENT DOCUMENTS 1,177,972 A * 4/1916 Stromdahl ..... 112/62
1,572,957 A * 2/1926 Reed ..... 112/62
2,716,387 A * 8/1955 Muller et al. ..... 112/62
3,266,059 A * 8/1966 Stelle ..... 623/62
4,393,728 A * 7/1983 Larson et al. ..... 74/469
4,905,615 A * 3/1990 Pofferi ..... 112/2.1
5,875,726 A * 3/1999 Keilmann ..... 112/470.13
5,964,171 A * 10/1999 Ciucani ..... 112/475.08
6,129,031 A * 10/2000 Sarh et al. ..... 112/470.13

* cited by examiner

*Primary Examiner*—Ismael Izaguirre
(74) *Attorney, Agent, or Firm*—Troxell Law Office, PLLC

(57) ABSTRACT

A sewing machine includes a main frame, a retainer, a rocker arm assembly, a wire assembly, and a platform. The main frame contains therein a transmission mechanism. The retainer is mounted to the base of the main frame. The retainer defines a bore in which a first gear transmission assembly is received. A rocker arm retaining disk assembly is mounted on the bore. The rocker arm assembly includes a rocker arm body which forms a plurality of bent sections which is configured to have the thread engaging device opposing the main frame. The platform is mounted to the base of the main frame.

7 Claims, 8 Drawing Sheets

ALL-PURPOSE SEWING MACHINE

FIELD OF THE INVENTION

The present invention relates to a shoe sewing machine, and in particular to a shoe sewing machine that is improved in association with a retainer and a rocker arm assembly to allow the sewing machine to carry out sewing operation at any location of a shoe and being applicable to sewing machines of footwares and handbags and the likes.

BACKGROUND OF THE INVENTION

For modern people, shoes are not just for protection of soles in walking or running, and aesthetics and durability of also major considerations of the shoes. Thus, designs of shoes become complicated and versatile. Bonding of a shoe vamp is no longer limited to an upper edge of a shoe sole. Some market available shoes have very versatile bonding between the vamps and the soles. All these constitute major challenges to a shoe sewing machine.

FIG. 8 of the attached drawings shows a conventional shoe sewing machine. The conventional shoe sewing machine has a rocker arm 2 comprising a thread engaging device 1 onto which a shoe to be sewn is fit. The rocker arm 2 is supported on a rotation disk 3 for reciprocal rotation for carrying out sewing an edge of a joint between the vamp and the sole.

The conventional shoe sewing machine is only suitable for sewing operation for vamp bonded to an upper edge of the shoe sole. Sewing can only be carried out on opposite sides of the shoe sole. In case the joint between the vamp and the sole is located away from the sole or irregular patterns of sewn lines are to be formed on the vamp, the sewing is first done on an additional vamp, and thereafter, the vamp and the sole are jointed by extra processing. Further, the conventional shoe sewing machine is not able to sew thick vamp and in such a case, a secondary processing is needed to attach the vamp to the sole. This often leads to separation between the vamp and the sole after a long term use.

Thus, the present invention is aimed to provide an all purpose shoe sewing machine that overcomes the drawback that the conventional shoe sewing machine cannot carry out sewing at locations away from the sole of a shoe.

SUMMARY OF THE INVENTION

An objective of the present invention is to provide a shoe sewing machine having improved retainer and a rocker arm assembly to allow the sewing machine to carry out sewing operation on all locations of a shoe, and the sewing can be done for irregular patterns formed on the shoe.

Another objective of the present invention is to provide a shoe sewing machine having a wire assembly functioning to drive a needle plate so as to simplify transmission and to alleviate problems caused by wear of transmission shaft and gears.

A further objective of the present invention is to provide a sewing machine that is suitable for sewing a thick vamp to a shoe sole in a stable and durable manner.

To realize the above objectives, in accordance with the present invention, an all-purpose sewing machine is provided, comprising a main frame, a retainer, a rocker arm assembly, a wire assembly, and a platform. The main frame contains therein a transmission mechanism. The main frame has a top forming a head portion and a bottom forming a base. The retainer is mounted to the base of the main frame.

The retainer defines a bore in which a first gear transmission assembly is received. A rocker arm retaining disk assembly is mounted on the bore. The first gear transmission assembly is in driving coupling with the transmission mechanism of the main frame and extends through the rocker arm retaining disk assembly. The rocker arm assembly comprises a rocker arm body which forms a plurality of bent sections. A second gear transmission assembly is arranged in the rocker arm body and is in driving coupling with the first gear transmission assembly of the retainer. The second gear transmission assembly functions to drive a thread engaging device arranged on the rocker arm body. The thread engaging device comprises a needle plate, and the rocker arm body forms a pivot connection at a front side thereof, the pivot connection being fit over the rocker arm retaining disk assembly. The rocker arm body that forms a plurality of bent sections is configured to have the thread engaging device opposing the main frame. The wire assembly extends from opposite sides of the needle plate of the thread engaging device through the thread engaging device, the rocker arm body, and the rocker arm retaining disk assembly for driving the needle plate so as to maintain a fixed position of the needle plate when the rocker arm assembly reciprocally rotates. The platform is mounted to the base of the main frame.

BRIEF DESCRIPTION OF THE DRAWINGS

The present invention will be apparent to those skilled in the art by reading the following description of a preferred embodiment thereof with reference to the drawings, in which.

DETAILED DESCRIPTION OF THE PREFERRED EMBODIMENT

Figure 1:
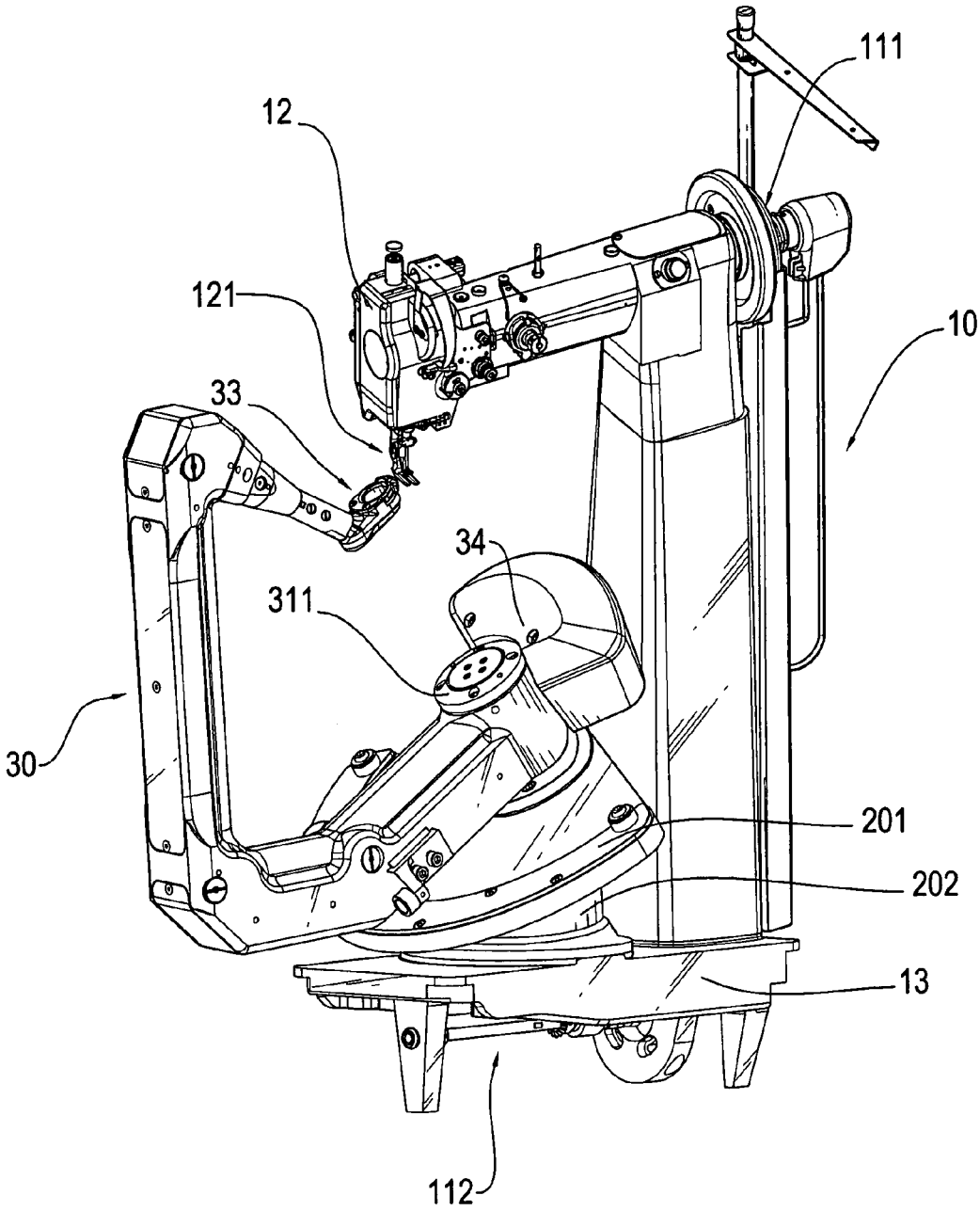
FIG. 1 is a perspective view of a sewing machine constructed in accordance with the present invention.
Figure 2:
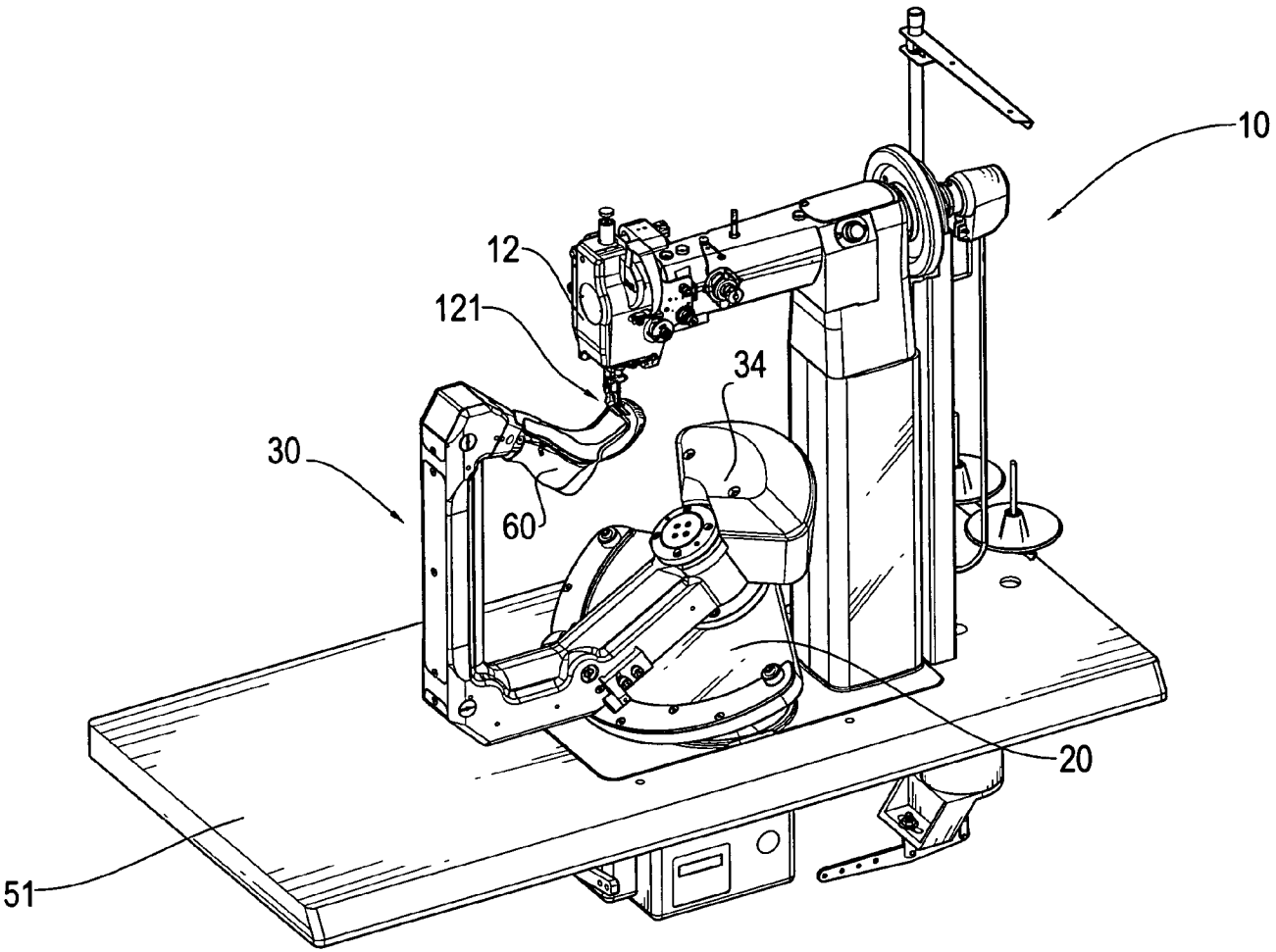
FIG. 2 is a perspective view of the sewing machine in sewing a shoe.
Figure 3:
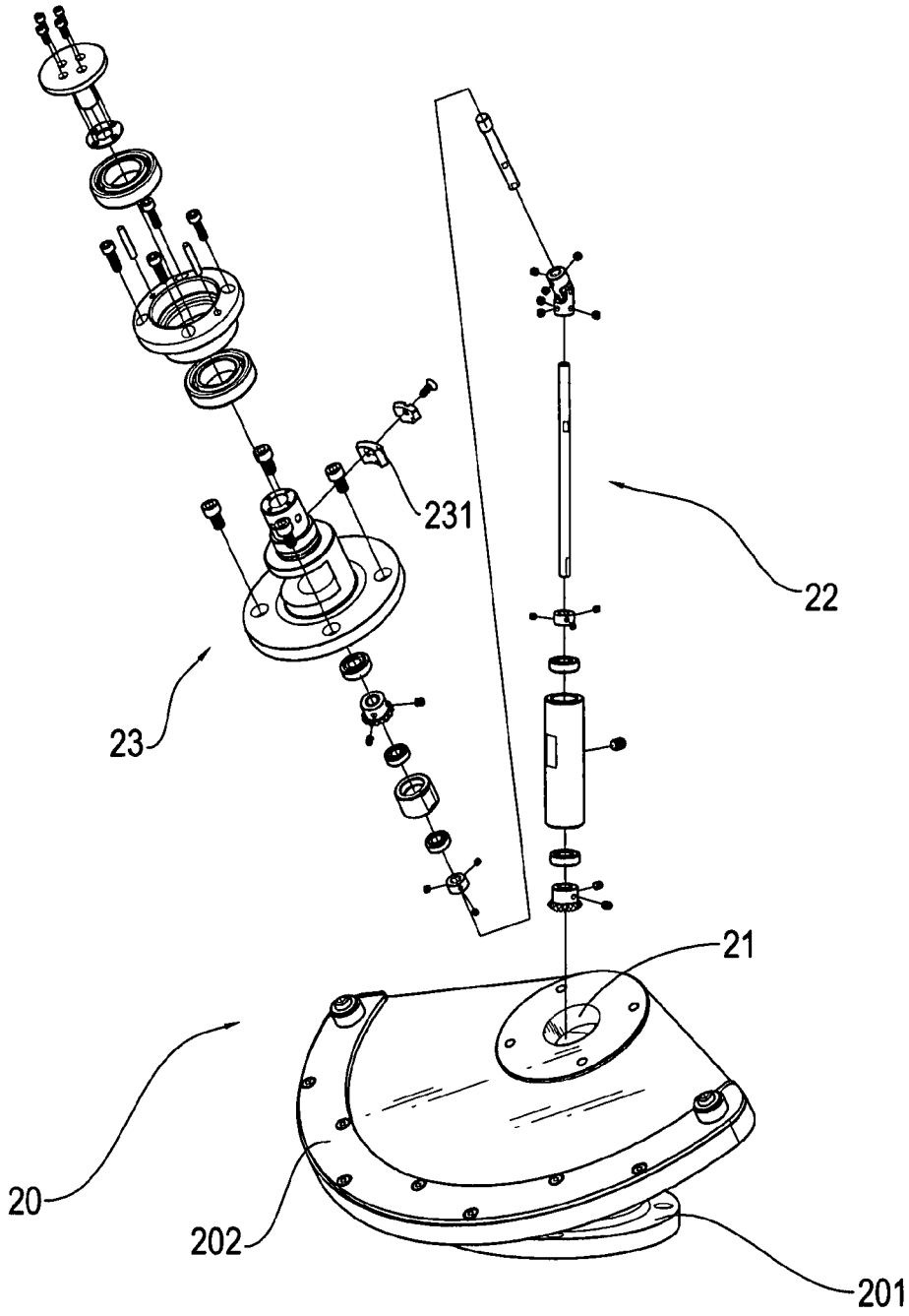
FIG. 3 is an exploded view of a rocker arm retaining disk assembly of the sewing machine of the present invention.
Figure 4:
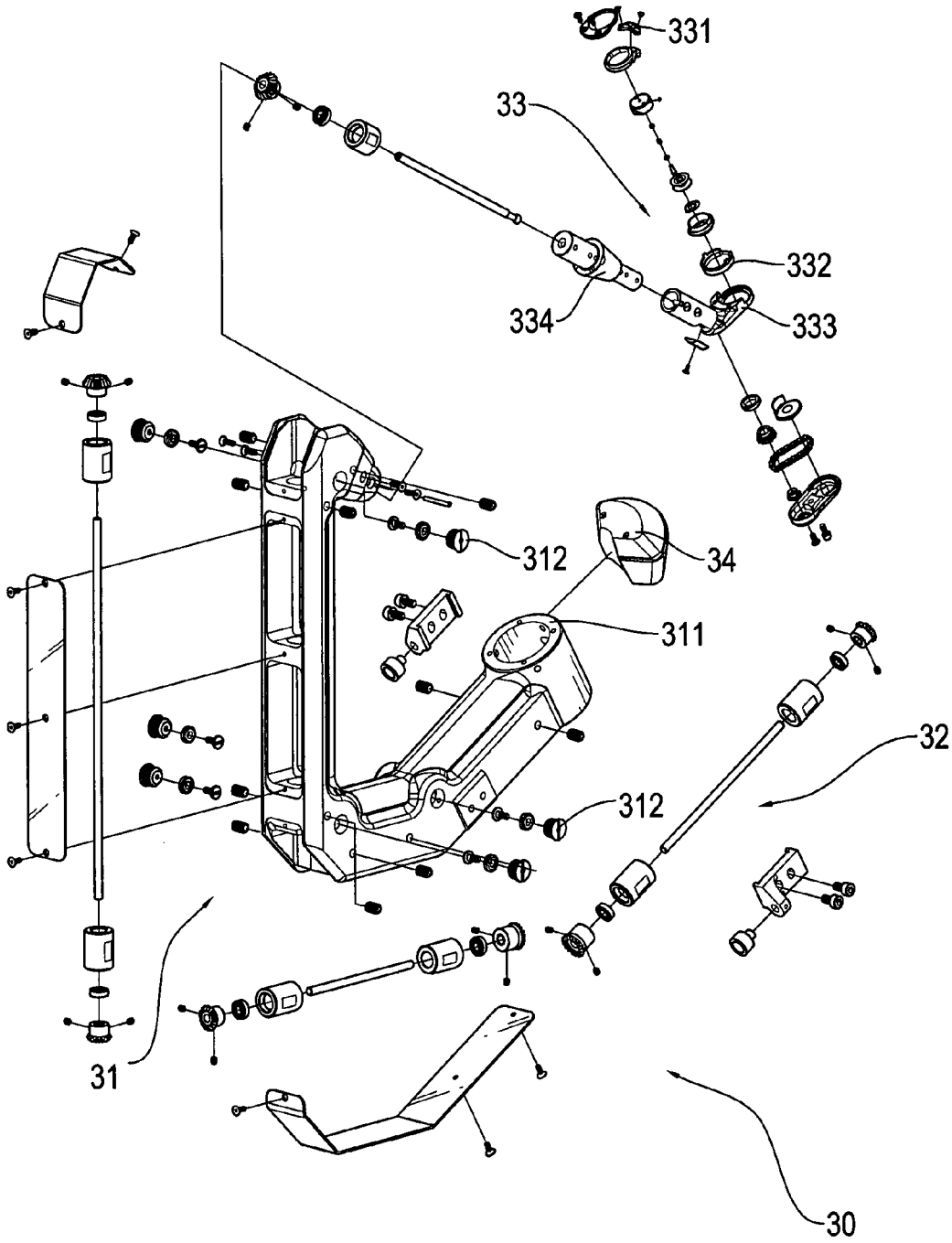
FIG. 4 is an exploded view of a rocker arm assembly of the sewing machine of the present invention.
Figure 5:
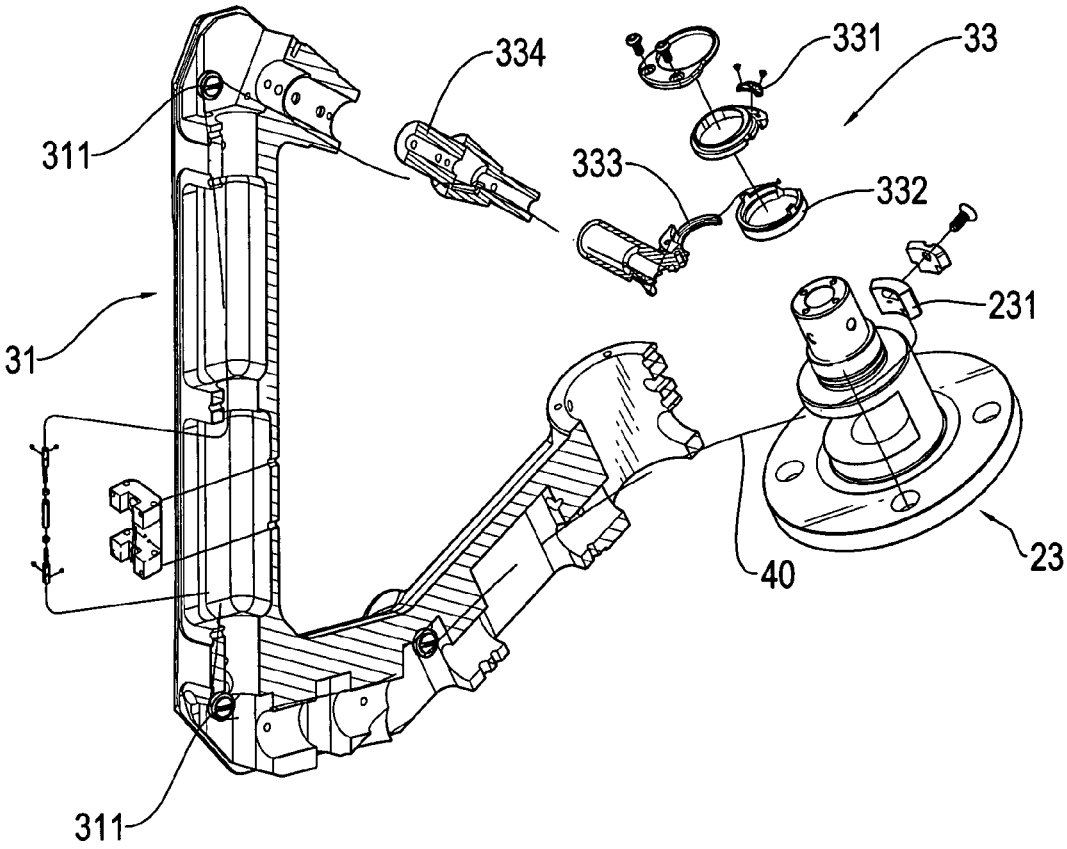
FIG. 5 is a perspective view, partially broken, of the rocker arm assembly of the sewing machine of the present invention.

With reference to the drawings and in particular to FIGS. 1-5, the present invention provides an all-purpose sewing machine and the all-purpose sewing machine comprises a main frame 10 containing therein a transmission mechanism comprising a pulley-belt assembly 111 and a gear set 112, which will be referred to as "third gear set" hereinafter. The pulley-belt assembly 111 is arranged at one side of the main frame 10 and is in driving coupling with the third gear set 112 in order to transmit power from the pulley-belt assembly 111 to the third gear set 112. A head portion 12 is mounted to a top of the main frame 10 for carrying and supporting a needle assembly 121 of the sewing machine, and a base 13 is provided at a bottom of the main frame 10 and carries the third gear set 112 on an under side thereof.

A retainer 20 has a bottom forming a stand 202 for mounting the retainer 20 to the base 13 of the main frame 10 and a top to which a carrier block 201 is fixed. A bore 21 is defined in the retainer 20 and receives a first gear transmission assembly 22. A rocker arm retaining disk assembly 23 is mounted on the bore 21. The rocker arm retaining disk assembly 23 carries a needle plate adjusting block 231. The first gear transmission assembly 22 is in driving coupling with the third gear set 112 of the transmission mechanism 11 of the main frame 10 and extends through the rocker arm retaining disk assembly 23.

A rocker arm assembly 30 comprises a rocker arm body 31 that forms a plurality of bent sections. Provided inside the rocker arm body 31 are a plurality of wire rollers 312 for guiding a wire assembly and a second gear transmission assembly 32 that is in driving coupling the first gear transmission assembly 22 of the retainer 20. The second gear transmission assembly 32 serves to drive a thread engaging device 33 that is arranged on the rocker arm body 31. The thread engaging device 33 comprises a needle plate 331, a carrier ring 332, a horn 333, and a handle 334. The needle plate 331 and the carrier ring 332 are mounted on the horn 333 and the horn 333 is, in turn, fit over the handle 334 and the handle 334 is inserted into the rocker arm body 31 to form the thread engaging device 33. The handle 334 is provided, at a front side thereof, with a pivotal connection 311, which is fit over the rocker arm retaining disk assembly 23. A counterweight 34 is provided to a circumferential surface of the pivotal connection 311. The rocker arm body 31, which forms a plurality of bent sections, is configured to have the thread engaging device 33 opposing the main frame 10.

A steel wire assembly 40 extends from opposite sides of the needle plate 331 of the thread engaging device 33 through the carrier ring 332, the horn 333, and the handle 334 of the thread engaging device 33 and further extends around the wire rollers 312 arranged inside the rocker arm body 31 to be guided by the wire rollers 312 through the rocker arm body 31 and eventually reaching the needle plate adjusting block 231 of the rocker arm retaining disk assembly 23, whereby the wire assembly 40 functions to drive the operation of the needle plate 331 and to maintain a fixed position of the needle plate 331 during the reciprocal rotation of the rocker arm assembly 30.

A platform 51 is mounted to the base 13 of the main frame 10.

Figure 6:
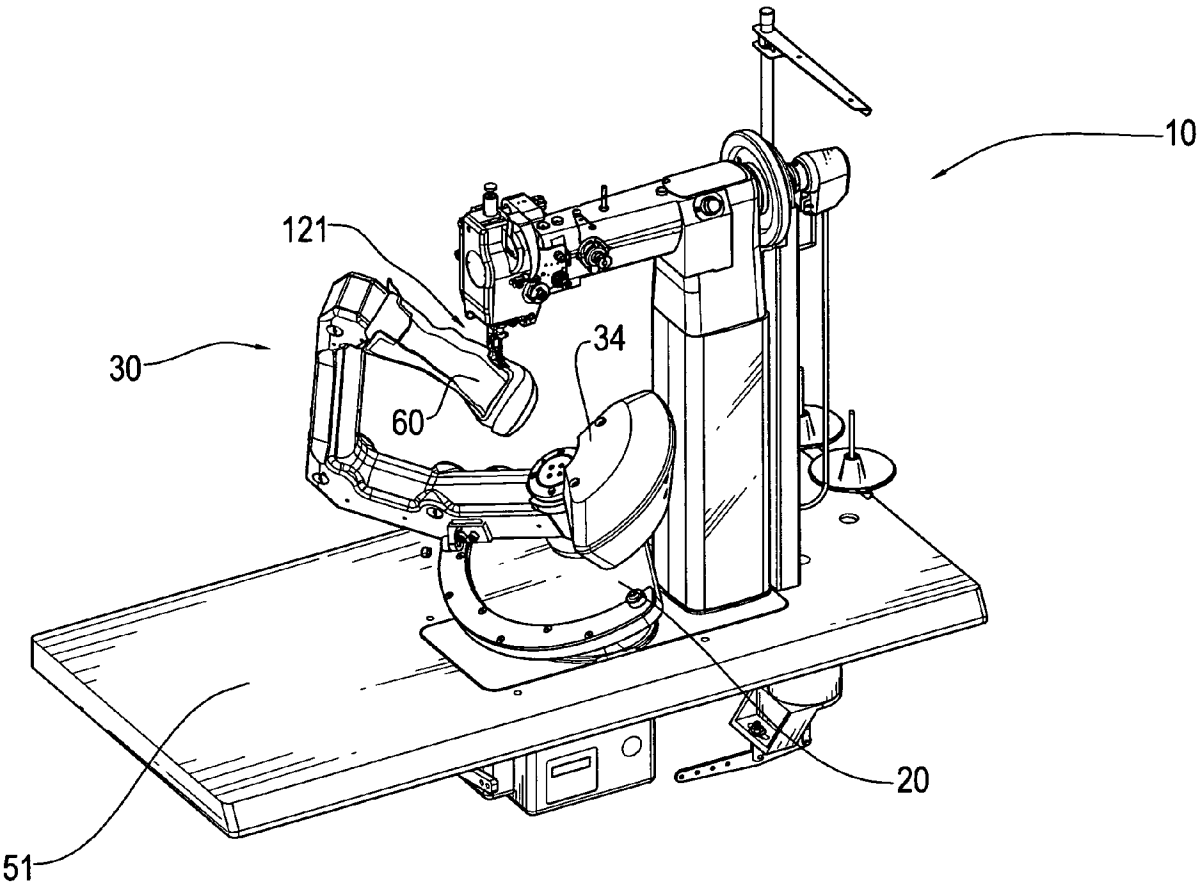
FIG. 6 is a perspective view of the sewing machine of the present invention, illustrating sewing operation performed by the sewing machine.
Figure 7:
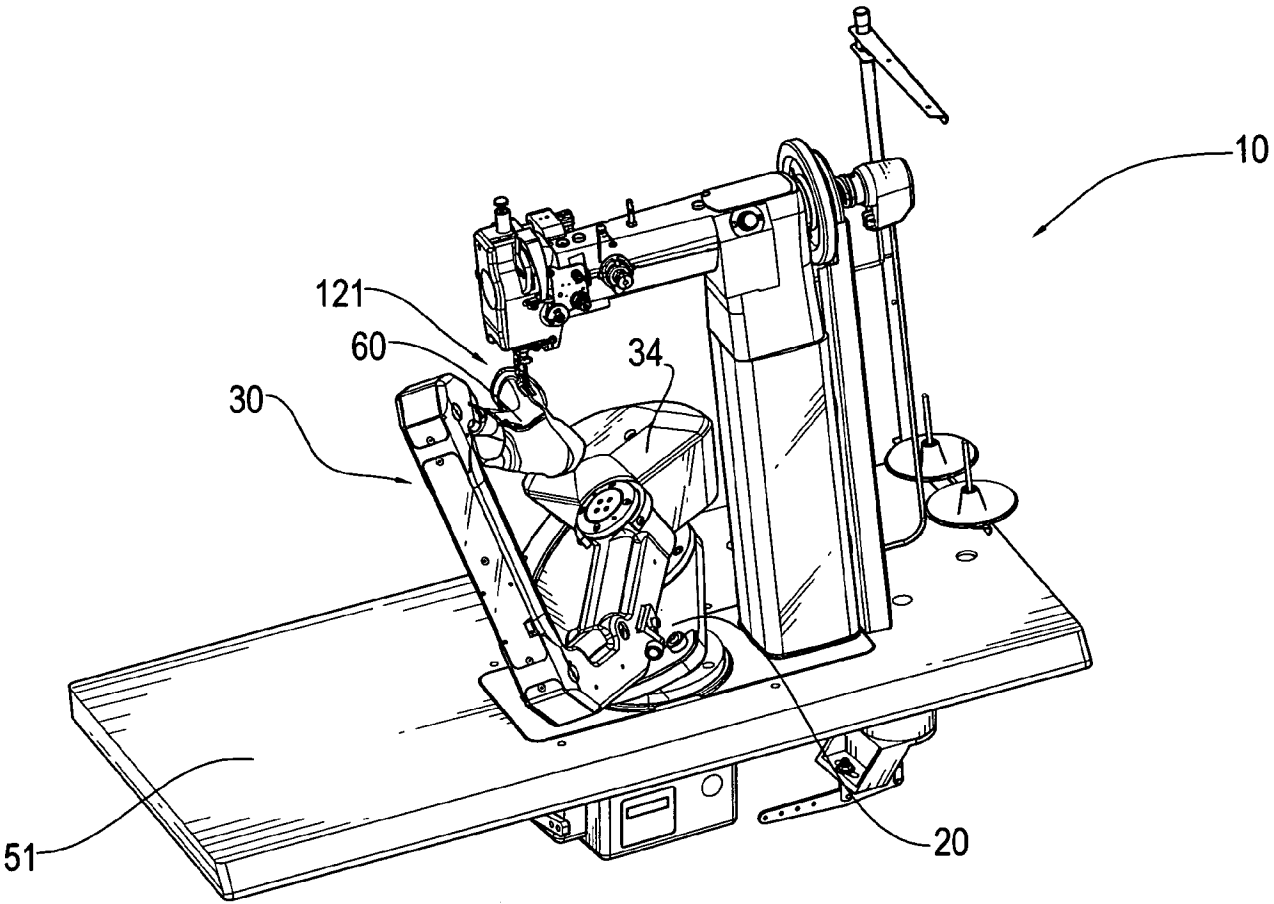
FIG. 7 is a perspective view of the sewing machine of the present invention, illustrating another sewing operation performed by the sewing machine.
Figure 8:
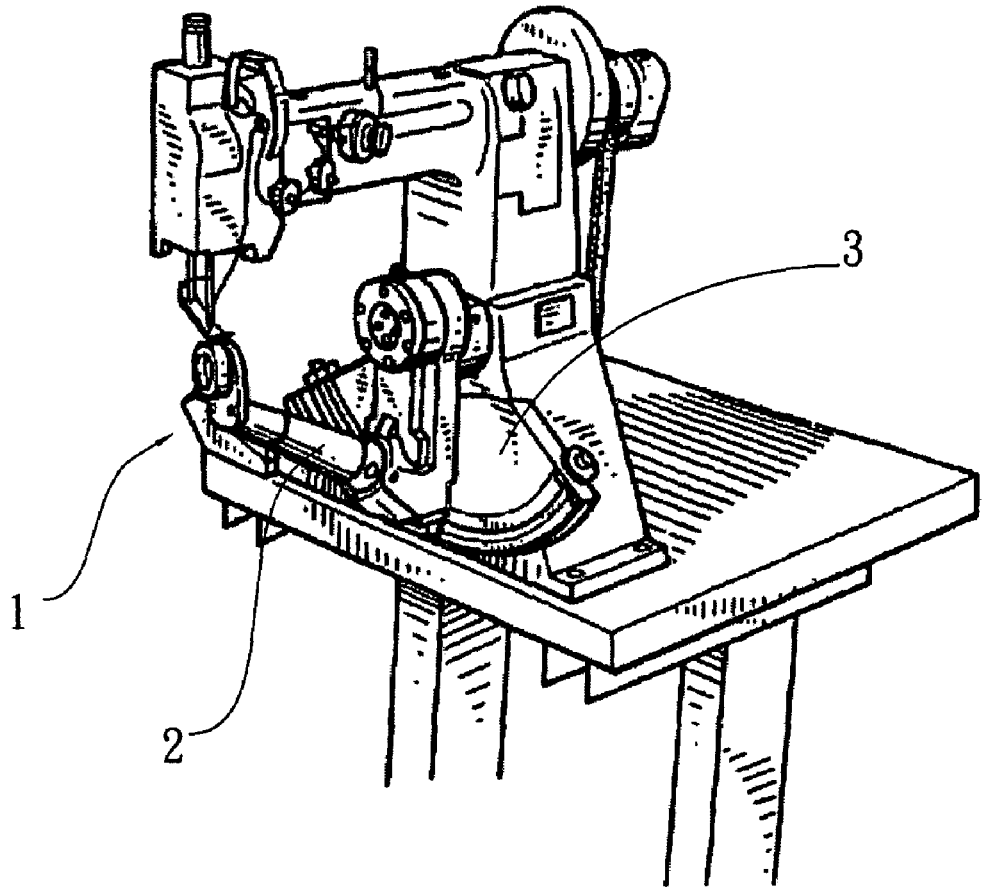
FIG. 8(Prior Art)
FIG. 8 is a perspective view of conventional shoe sewing machine.

With reference to FIGS. 1-7, the above described structure provides an all purpose sewing machine in accordance with the present invention. With the base 13 of the main frame 10 mounted to the platform 51, the major construction of the above-discussed sewing machine is supported by the platform 51. Also, the retainer 20 is provided at the bottom thereof with the stand 202 that is mounted to the base 13 of the main frame 10, and the pivot connection 311 of the rocker arm assembly 30 is fit over the rocker arm retaining disk assembly 23 of the retainer 20, whereby with the arrangement of the gear transmission assembly 22 and the rocker arm retaining disk assembly 23 of the retainer 20, the rocker arm assembly 30 is allowed to reciprocally rotated on the carrier block 201 for positioning purposes and as a consequence thereof, the thread engaging assembly 33 rotates with the rocker arm assembly 30 and thus changes position thereof. The outer circumference of the pivot connection 311 of the rocker arm assembly 30 is provided with the counterweight 34, and the arrangement of the counterweight 34 facilitates positioning of the rocker arm assembly 30 during its reciprocal rotation. In addition, the wire assembly 40, which is arranged to extend through the thread engaging device 33, the rocker arm body 31, and the rocker arm retaining disk assembly 23, functions to drive the needle plate 331 of the thread engaging device 33 to do relative reciprocal rotation so that when the rocker arm assembly 30 is reciprocally rotated, the needle plate 331 and the needle assembly 121 are maintained at a relative position for sewing operation. The wire assembly 40 is used to replace the conventional complication transmission consisting of a transmission shaft, a joint, and gears whereby the use of the transmission shaft and gears that are susceptible of wearing is eliminated in the present invention and needle leaping caused by the wearing is prevented. Thus, likelihood of malfunctioning, parts to be replaced and costs of maintenance are reduced. Also referring to FIG. 6, with the overall construction consisting of the retainer 20, the rocker arm assembly 30, and the wire assembly 40 and the multiple bent-sections of the rocker arm body 31 that supports the thread engaging device 33 opposing the main frame 10, when a shoe 60 is positioned on the thread engaging device 33 of the rocker arm body 31, the needle assembly 121 of the head portion 12 is allowed to sew the portion of shoe vamp that is distant from shoe sole. Further with reciprocal rotation of the rocker arm assembly 30 on the carrier block 201 of the retainer 20, any portion of the vamp of the shoe 60 can be sewed with desired curved lines and patterns by the sewing machine of the present invention. Also referring to FIGS. 6 and 7, the rocker arm assembly 30 can be rotated sideways to facilitate sewing operation on the sides and heel of the shoe 60 to realize sewing on all positions of the shoe.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A sewing machine comprising:

a main frame containing therein a transmission mechanism, the main frame having a top forming a head portion and a bottom forming a base;

a retainer mounted to the base of the main frame, the retainer defining a bore receiving therein a first gear transmission assembly, a rocker arm retaining disk assembly mounted on the bore, the first gear transmission assembly being in driving coupling with the transmission mechanism of the main frame and extending through the rocker arm retaining disk assembly;

a rocker arm assembly comprising a rocker arm body which forms a plurality of bent sections, a second gear transmission assembly being arranged in the rocker arm body and in driving coupling with the first gear transmission assembly of the retainer, the second gear transmission assembly driving a thread engaging device arranged on the rocker arm body, the thread engaging device comprising a needle plate, the rocker arm body forming a pivot connection at a front side thereof, the pivot connection being fit over the rocker arm retaining disk assembly, the rocker arm body that forms a plurality of bent sections being configured to have the thread engaging device opposing the main frame;

a wire assembly extending from opposite sides of the needle plate of the thread engaging device through the thread engaging device, the rocker arm body, and the rocker arm retaining disk assembly for driving the needle plate so as to maintain a fixed position of the needle plate when the rocker arm assembly reciprocally rotates; and a platform mounted to the base of the main frame.

2. The sewing machine as claimed in claim 1, wherein the transmission mechanism contained in the main frame comprises a pulley-belt assembly and a third gear set, the pulley-belt assembly being arranged at one side of the main frame, the third gear set being arranged under the base of the main frame.

3. The sewing machine as claimed in claim 2, wherein the pulley-belt assembly is in driving coupling with the third gear set so that the pulley-belt assembly drives the third gear set.

4. The sewing machine as claimed in claim 1, wherein a plurality of wire rollers is arranged inside the rocker arm body for guiding the wire assembly.

5. The sewing machine as claimed in claim 1, wherein a needle plate adjusting block is mounted to the rocker arm retaining disk assembly.

6. The sewing machine as claimed in claim 1, wherein the retainer has a top forming a carrier block to support reciprocal rotation of the rocker arm assembly thereon.

7. The sewing machine as claimed in claim 1, wherein the pivot connection of the rocker arm body has an outer circumference to which a counterweight is mounted.

* * * * *